United States Patent [19]

Van Lue et al.

[11] Patent Number: 4,538,492

[45] Date of Patent: Sep. 3, 1985

[54] BEAN CUTTER

[76] Inventors: Benjamin H. Van Lue; Timothy A. Van Lue; Vincent V. Vanlue, all of Route 1, Granby, Mo. 64844

[21] Appl. No.: 576,254

[22] Filed: Feb. 1, 1984

[51] Int. Cl.[3] ..... B26D 7/06

[52] U.S. Cl. ..... 83/411 R; 83/165; 83/403.1; 83/423; 83/858; 198/531

[58] Field of Search ..... 83/411 R, 423, 403.1, 83/165, 858; 198/531, 532, 530

[56] References Cited

U.S. PATENT DOCUMENTS

| | | | |
|---|---|---|---|
| 674,273 | 5/1901 | Lewis | 83/411 R X |
| 822,218 | 5/1906 | Mueller | 83/411 R |
| 824,641 | 6/1906 | Garrigus | 83/411 R |
| 2,236,150 | 3/1941 | Maltby | 83/411 R |
| 2,641,352 | 6/1953 | Charles et al. | 198/531 |
| 3,538,802 | 11/1970 | Helm et al. | 83/411 R |
| 4,040,459 | 8/1977 | Bush, Jr. et al. | 83/411 R X |
| 4,274,531 | 6/1981 | Whitmore | 198/531 X |

*Primary Examiner*—Frank T. Yost

*Attorney, Agent, or Firm*—Harvey B. Jacobson; Clarence A. O'Brien

[57] ABSTRACT

An inclined chute is provided for receiving side-by-side transversely extending elongated beans thereon for gravity lateral feeding of the beans downwardly along the chute. A rotary shaft is disposed outward of and below the lower end of the chute and a plurality of axially spaced wheels are mounted on the shaft for rotation therewith. The wheels include axially registered radially outwardly projecting arms whose outer ends are hooked in the direction of rotation of the shaft and stationary knife structure is disposed between adjacent wheels on the sides thereof remote from the chute. The registered arms of the wheels are operative to engage, support and convey beans from the lower end of the chute past the knife structure for cutting of the beans into a plurality of short bean member sections. Additional bean tipping blades are provided adjacent the axial ends of the shaft for tipping the beans and a cutting blade-equipped divider plate may be mounted between adjacent wheels for tipping shorter beans.

8 Claims, 7 Drawing Figures

BEAN CUTTER

BACKGROUND OF THE INVENTION

Various different mechanisms heretofore have been provided for cutting stringbeans into short bean sections and for cutting the tip ends of the beans therefrom. However, most of these previously known mechanisms are quite complex, expensive and designed for use on a commercial production line for processing beans and are therefore not suitable for use by an individual. Accordingly, a need exists for a simplified bean cutter which may be used not only to tip the opposite ends of a stringbean but which will also serve to cut the tipped stringbeans into predetermined length bean sections.

Examples of various different forms of devices including some of the general structural and operational features of the instant invention are disclosed in U.S. Pat. Nos. 1,639,039, 1,860,779, 1,993,197, 2,150,735, 2,293,140, 2,321,735, 2,361,147, 2,681,091 and 3,797,338.

BRIEF DESCRIPTION OF THE INVENTION

The bean cutter of the instant invention includes an inclined chute for receiving side-by-side transversely extending elongated beans thereon for gravity lateral feeding of the beans downwardly along the chute. A rotary shaft is disposed outward of and below the lower end of the chute and supports a plurality of axially spaced wheels thereon. The wheels include axially registered radially outwardly projecting arms whose outer ends are hooked in the direction of rotation of the shaft and stationary knife structure is disposed between adjacent wheels on the sides thereof remote from the chute. Registered arms of the wheels engage, support and convey beans from the lower end of the chute past the knife means for cutting of each of the beans into a plurality of short bean sections. In addition to the bean cutting knives other stationary knives are provided at opposite axial ends of the shaft for tipping the beans being cut and the tipping knives tip the beans immediately prior to them being cut into short lengths by the first-mentioned knives. In addition, the lower end of the chute is pivotally supported for oscillation relative to the remaining upper portion of the chute about a horizontal axis extending transversely of the chute between a lower position substantially coextensive with the upper portion of the chute and a raised position reducing the effect of gravity feed of beans downwardly along the lower end portion. The lower end of the chute is engageable by registered arms of the wheels to displace the chute lower end portion from the lowered position thereof to the raised position thereof as each set of registered arms of the wheels swing upwardly past the chute lower end. In this manner, the feed of beans from the chute into the hooked arms is controlled.

The main object of this invention is to provide a bean cutter which will be operative to tip stringbeans and to cut stringbeans into short stringbeans lengths.

Another object of this invention is to provide a bean cutter in accordance with the preceding object and incorporating structure features which render the bean cutter suitable for use by an individual in processing a limited number of beans.

Another very important object of this invention is to provide a bean cutter which is portable and may be readily mounted from a suitable table or counter top.

Still another important object of this invention is to provide a bean cutter which is manually driven, but which may be motorized, if desired.

Another very important object of this invention is to provide a bean cutter which may be adjusted to compensate for beans of different lengths. A final object of this invention to be specifically enumerated herein is to provide a bean cutter in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
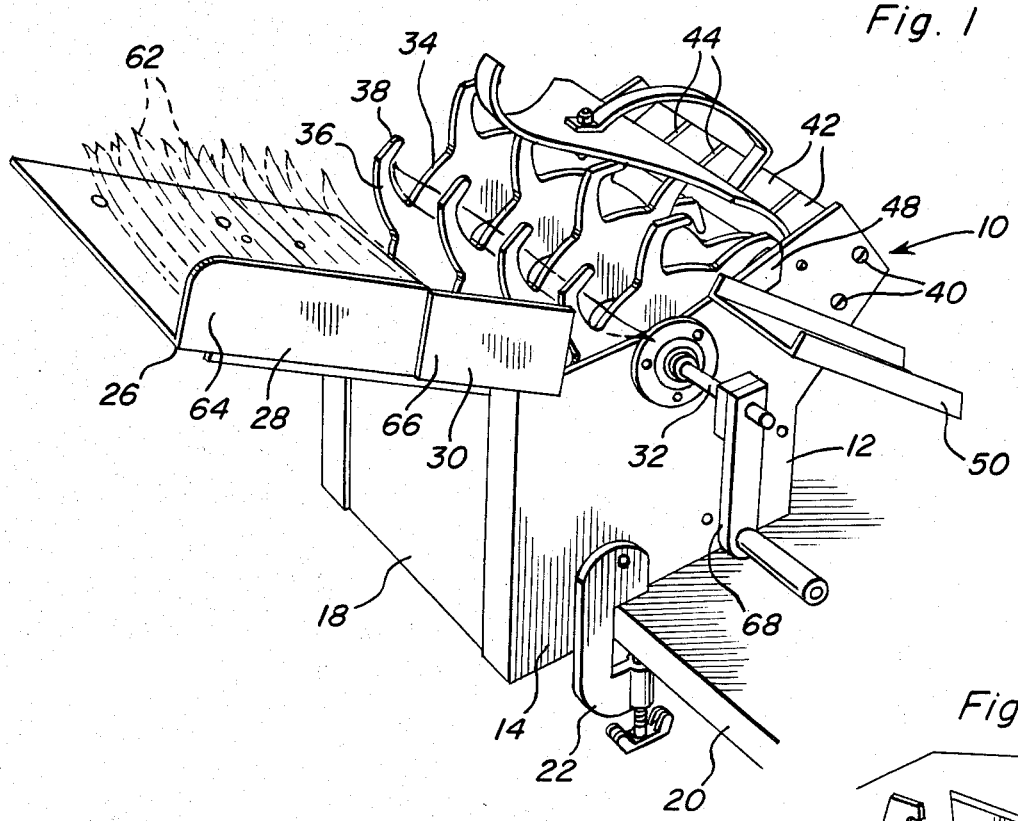
FIG. 1 is a perspective view of the bean cutter.
Figure 4:
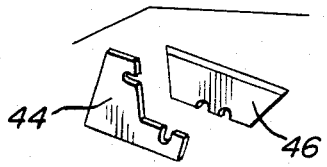
FIG. 4 is an exploded perspective view of one cutting blade supporting spacer and an associated "Stanley" sheetrock cutting blade.

Referring now more specifically to the drawings the numeral 10 generally designates the bean cutter of the instant invention. The bean cutter 10 includes a heavy gauge sheet metal frame 12 including upstanding opposite end plates 14 and 16 interconnected by an upstanding rear plate 18. The frame 12 may be supported from and anchored relative to one marginal edge portion of a counter or tabletop 20 through the utilization of a pair of C-clamps 22 carried by the end plates 14 and 16 and the rear plate 18 supports a pair of upwardly and outwardly inclined brackets 24 therefrom. The brackets 24 support an inclined feeding chute 26 including a stationary upper end portion 28 and a pivoted lower end portion 30 hingedly supported, as at 31, from the lower extremity of the upper end portion 28. The lower end portion 30 is swingable between the lower solid line position thereof illustrated in FIG. 3 and the upper phantom line position illustrated in FIG. 3.

A support shaft 32 is journalled from the end plates 14 and 16 and supports four axially spaced wheels 34 thereon between the end plates 14 and 16. The wheels 34 include registered circumferentially spaced and outwardly projecting arms 36 including outer end portions 38 hooked in the direction of intended rotation of the shaft 32. Further, a pair of support rods 40 are removably secured between upper forward portions of the end plates 14 and 16 and mount a plurality of aligned spacer blocks 42 therefrom. A spacer plate 44 is supported between each pair of spacer blocks 42 from the support rods 40 and each spacer plate 44 supports a "Stanley" sheetrock cutting blade 46 therefrom. In addition, each of the end plates 14 and 16 supports a further cutting blade 48 therefrom.

The outer sides of the forward portions of the end plates 14 include discharge chutes 50 supported therefrom and an arcuate wheel shroud 52 is hingedly supported between the end plates 14 and 16 as at 54 and overlies the upper peripheral portions of the wheels 34 on the side thereof remote from the chute 26. A leaf spring 56 serves to yieldingly bias the shroud 52 in a clockwise direction as viewed in FIG. 3 of the drawings so that the underside of the shroud 52 contacts the outer extremities of the end portions 38 of the arms 36.

With attention invited again to FIG. 3, the lower portions of the wheels 34 remote from the chute 26 are closely opposed by a partial cylindrical shroud 58 which terminates downwardly in a reversely curving and downwardly directed lower end portion 60 spaced slightly forward of the rear panel 18.

Figure 3:
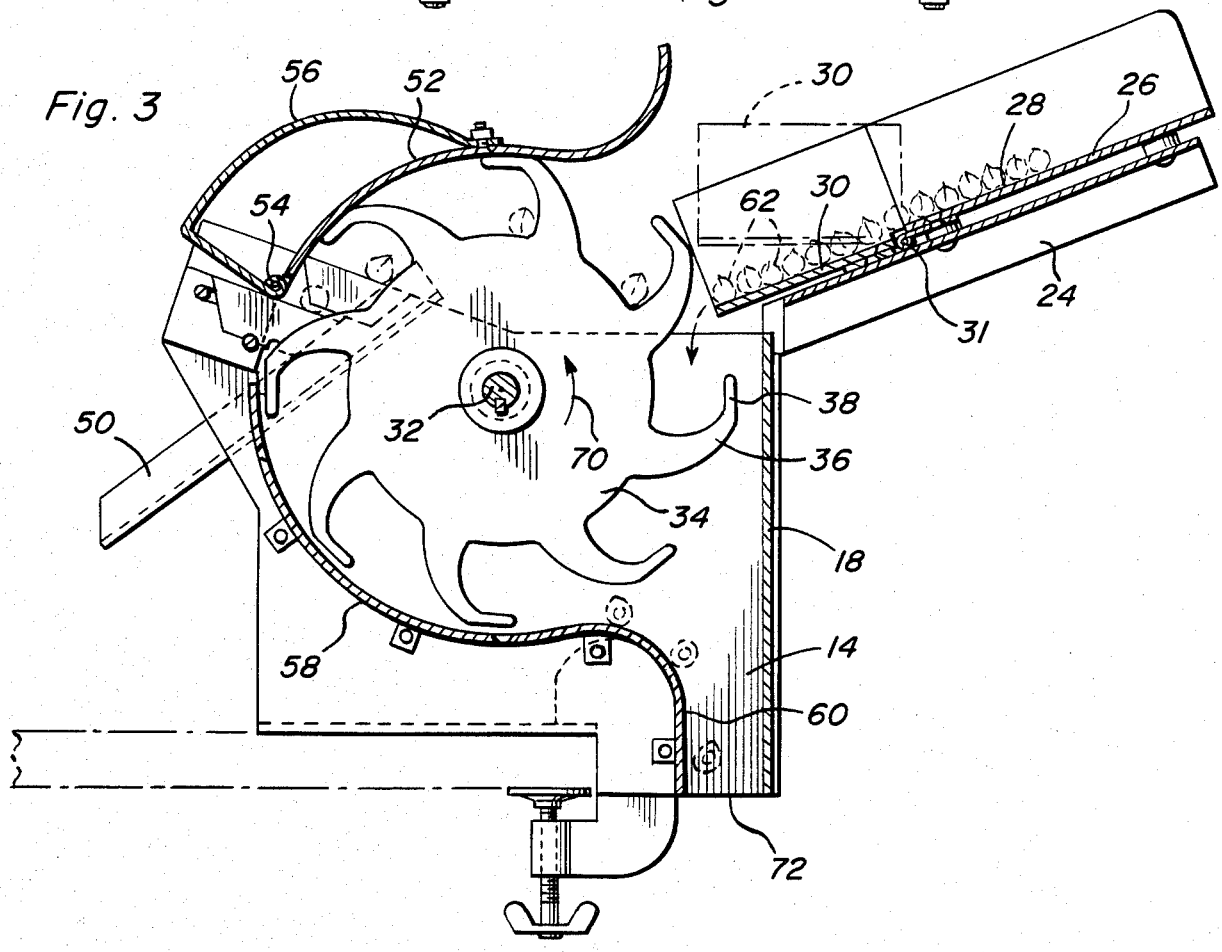
FIG. 3 is a vertical sectional view taken substantially upon the plane indicated by the section line 3—3 of FIG. 2.

In operation, beans to be cut are placed upon the chute 26 in side-by-side transversely extending relation as indicated as at 62 in FIGS. 1 and 3 of the drawings with one set of corresponding ends of the beans 62 abutting the upstanding fence portions 64 and 66 carried by the upper and lower end portions 28 and 30. The shaft 32 is provided with a hand crank 68 by which the shaft 32 may be rotated and upon actuation of the crank 68 to rotate the shaft 32 in the direction of the arrow 70 in FIG. 3 the outer end portions 38 of the arm 36 immediately beneath the free end of the lower end portion 30 receive beans 62 therefrom. However, continued rotation of the shaft 32 swings the arms 36 immediately beneath the lower end portion 30 upwardly toward the latter and the outer end portions 38 engage and upwardly displace the lower end portion 30 to the raised position thereof illustrated in phantom lines in FIG. 3 thus terminating the gravity feed of beans 62 from the lower end portion 30 until after the arms 36 engaged with the lower end portion 30 swing therepast. As those arms 36 swing past the lower end portion 30 the latter may swing back down to the solid line position thereof illustrated in FIG. 3 in order to enable the next approaching set of arms 36 to receive beans 32 from the lower end portion 30 of the feeding chute 26. As the beans 62 supported by the arms 36 swing over the upper portions of the wheels 34 they are carried downwardly toward the blades 48 and 46. The tip ends of the beans 62 are removed by the blades 48 and the remaining mid-length portions of the beans 62 are thereafter cut into individual length sections by the blades 46. The arms 36 continue to move the cut sections of beans 62 downwardly along the shroud 58 so that the cut beans sections may be discharged from the downwardly directed end portion 60 of the shroud 58 and the lower marginal edge of the rear panel 18 as at 72. Of course, a receptacle may be provided for receiving the cut bean sections discharged at 72.

Figure 6:
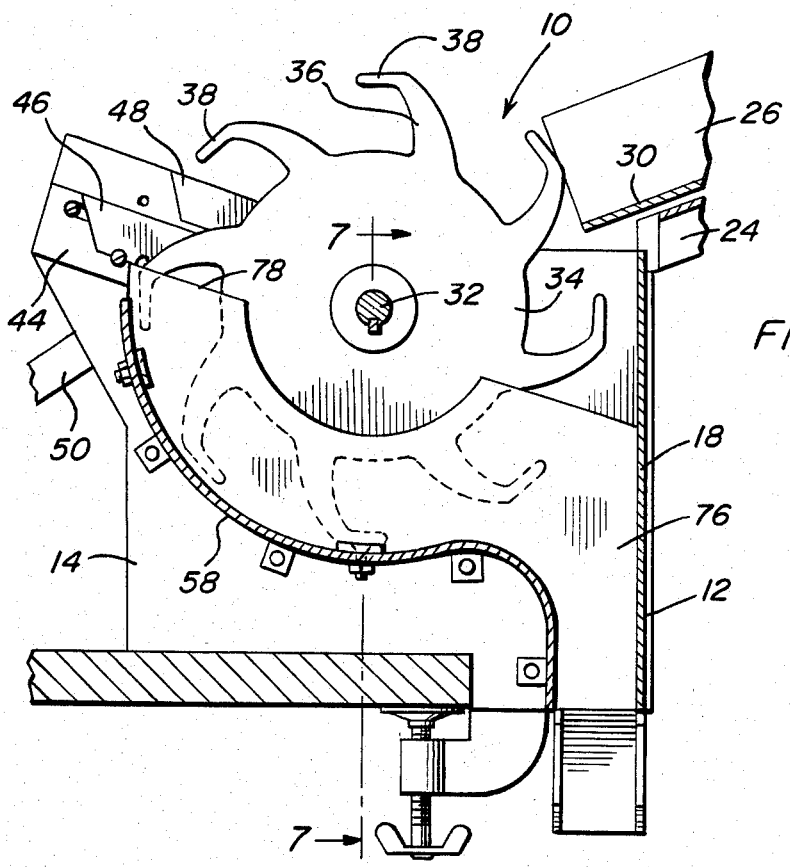
FIG. 6 is a vertical sectional view similar to FIG. 3, but with the wheel shroud removed and a divider attachment in place for use with shorter beans.
Figure 5:
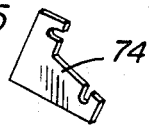
FIG. 5 is a perspective view of a modified form of cutting blade supporting spacer for use with other types of cutting blades.
Figure 7:
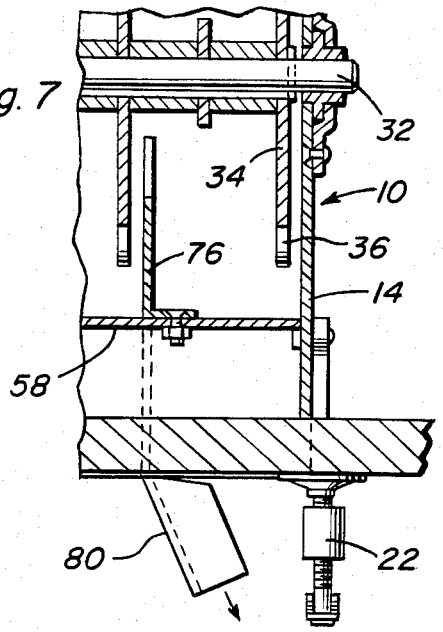
FIG. 7 is a fragmentary vertical sectional view taken substantially upon the plane indicated by the section line 7—7 of FIG. 6.
Figure 2:
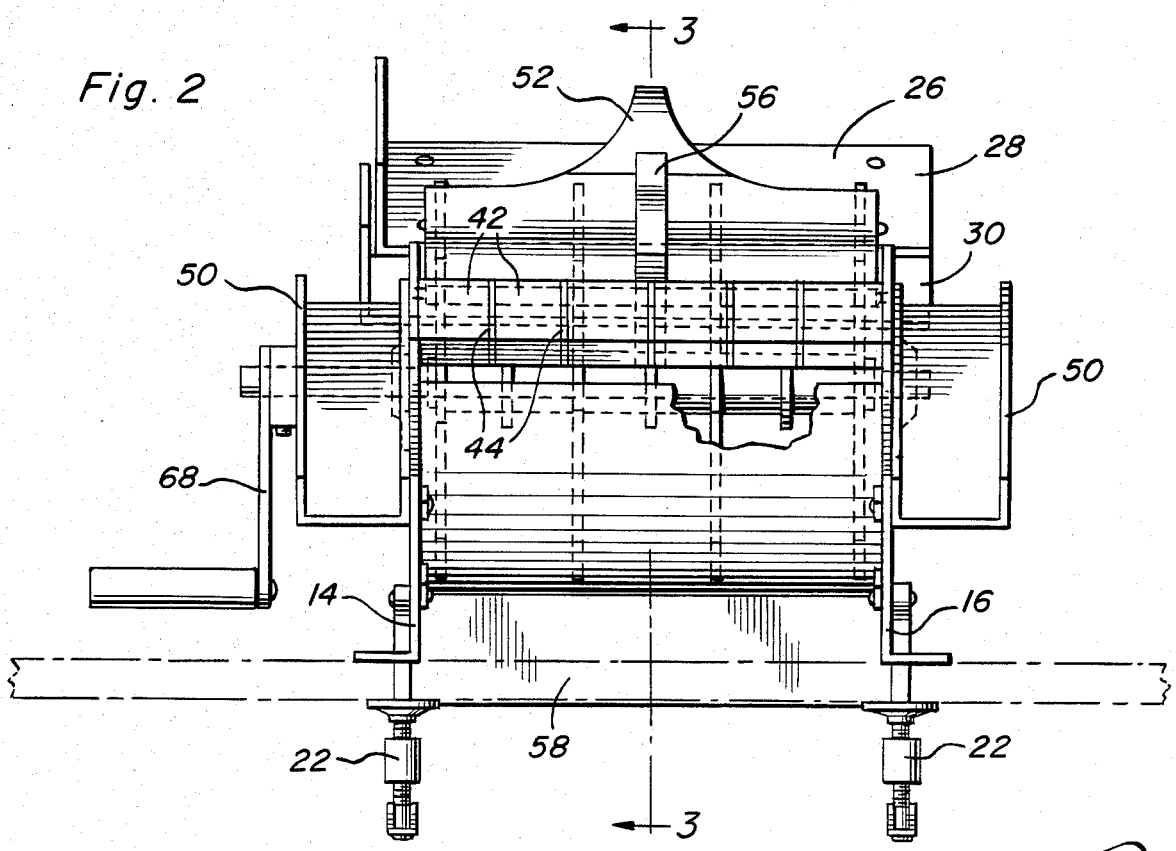
FIG. 2 is an enlarged rear elevational view of the bean cutter.

If other forms of blades are to be used in lieu of the "Stanley" sheetrock cutting blades 46, spacer plates 74 may be used in lieu of the spacer plates 44, see FIG. 5. Further, if the beans 62 are shorter than the distance between the end plates 14 and 16, a divider attachment 76 is supported from the shroud 58 as illustrated in FIGS. 6 and 7 and the divider shroud includes an upper cutting edge 78 which performs the function of the blade 48 remote from the end panel 14. The lower end of the divider attachment 76 includes an inclined chute portion 80 for directing the bean tips cut thereby away from the receptacle into which the cut bean sections are discharged at 72.

The spacing between the blades 46 may be varied by utilizing the spacer plates 44 only between every other pair of opposing spacer blocks 42. Therefore, the length of the cut bean sections discharged at 72 may be varied.

The bean cutter 10 can rapidly tip and cut reasonably large quantities of stringbeans. Although the bean cutter 10 is illustrated as manually operated, the crank 68 could be replaced by a gear reduction equipped electric motor in order to increase the production rate of the bean cutter 10.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A cutter including an inclined chute for receiving side-by-side transversely extending elongated members thereon for gravity lateral feeding of said elongated members downwardly along said chute, a rotary shaft disposed outward of and below the lower end of said chute, a plurality of axially spaced wheels mounted on said shaft for rotation therewith, said wheels including axially registered radially outwardly projecting and circumferentially spaced arms whose outer ends are hooked in the direction of intended rotation of said shaft, stationary knife means disposed between adjacent wheels on the sides thereof remote from said chute, the axially registered arms of said wheels being operable to engage, lift and convey elongated members from the lower end of said chute past said knife means for cutting said elongated members into a plurality of short elongated member sections, said chute including a lower end portion thereof hinged supported therefrom for angular displacement relative to the upper portion of said chute about a horziontal axis extending transversely of said chute, said lower end portion being swingable between a lower position substantially paralleling the adjacent upper portion of the chute and a raised position reducing the effect of gravity feed of said elongated members downwardly along said lower end portion, said registered arms being engageable with said lower end portion to swing the latter from said lower position toward said upper position as each set of registered arms of said wheels swing upwardly past the lower end of said chute.

2. The cutter of claim 1 including a partial cylindrical shroud closely overlying the upper peripheral portions of said wheels on the side thereof remote from said chute.

3. The cutter of claim 1 wherein said stationary knife means includes means for adjusting the spacing therebetween along the axis of rotation of said shaft.

4. The cutter of claim 1 wherein said knife means includes two knife members specifically positioned to cut the tip ends of said elongated members therefrom and the remainder of said knife means are positioned to cut the remaining portions of said elongated members into substantially equal length elongated member sections.

5. The cutter of claim 4 including a partial cylindrical shroud closely overlying the upper peripheral portions of said wheels on the side thereof remote from said chute.

6. The cutter of claim 1 wherein said cutter includes a pair of interconnected, laterally spaced and upstanding end plates from which said shaft is journalled with said shaft spanning between said plates, said wheels being spaced apart along said shaft between said plates, a crank mounted on one end of said shaft outwardly of the corresponding end plate, said plates including corresponding upstanding rear marginal edges between which a rear plate extends and is secured, said chute being mounted from and projecting upwardly and outwardly from said rear plate.

7. A cutter including an inclined chute for receiving side-by-side transversely extending elongated members thereon for gravity lateral feeding of said elongated members downwardly along said chute, a rotary shaft disposed outward of and below the lower end of said chute, a plurality of axially spaced wheels mounted on said shaft for rotation therewith, said wheels including axially registered radially outwardly projecting and circumferentially spaced arms whose outer ends are hooked in the direction of intended rotation of said shaft, stationary knife means disposed between adjacent wheels on the sides thereof remote from said chute, the axially registered arms of said wheels being operable to engage, lift and convey elongated members from the lower end of said chute past said knife means for cutting said elongated members into a plurality of short elongated member sections, a divider attachment stationarily mountable between one pair of opposing axially spaced wheels on said shaft, said shaft and wheels being rotatable relative to said divider attachment, said divider attachment including an edge portion thereof comprising a cutting edge for cutting the tip ends of short elongated members therefrom, said chute including a lower end portion thereof hingedly supported therefrom for angular displacement relative to the upper portion of said chute about a horizontal axis extending transversely of said chute, said lower end portion being swingable between a lower position substantially paralleling the adjacent upper portion of the chute and a raised position reducing the effect of gravity feed of said elongated members downwardly along said lower end portion, said registered arms being engageable with said lower end portion to swing the latter from said lower position toward said upper position as each set of registered arms of said wheels swing upwardly past the lower end of said chute.

8. The cutter of claim 7 including a partial cylindrical shroud closely overlying the upper peripheral portions of said wheels on the side thereof remote from said chute.

* * * * *